US005280683A

United States Patent [19]

Ping

[11] Patent Number: 5,280,683

[45] Date of Patent: Jan. 25, 1994

[54] FIRING MECHANISM WITH PIVOTING SEAR

[75] Inventor: Zhang Ping, Beijing City, China

[73] Assignee: Keng's Firearms Specialty, Inc., Atlanta, Ga.

[21] Appl. No.: 806,370

[22] Filed: Dec. 13, 1991

[51] Int. Cl.[5] ..... F41A 19/12

[52] U.S. Cl. ..... 42/69.03

[58] Field of Search ..... 42/69.03, 70.01, 70.04, 42/70.05, 70.06, 70.07; 89/141, 146, 148

[56] References Cited

U.S. PATENT DOCUMENTS

| | | | |
|---|---|---|---|
| 1,511,509 | 10/1924 | Diehm | 89/148 |
| 3,757,634 | 9/1973 | Urid et al. | 89/148 |

FOREIGN PATENT DOCUMENTS

| | | | |
|---|---|---|---|
| 371455 | 3/1923 | Fed. Rep. of Germany | 42/70.04 |
| 462561 | 11/1951 | Italy | 42/70.06 |
| 195928 | 5/1967 | U.S.S.R. | 42/69.03 |
| 6672 | 3/1913 | United Kingdom | 89/146 |

OTHER PUBLICATIONS

Jand's Infantry Weapons 1984-1985, "7.62 mm Simonov self-loading rifle (SKS)", 1984, pp. 208-209.

*Primary Examiner*—Stephen C. Bentley

*Attorney, Agent, or Firm*—Hopkins & Thomas

[57] ABSTRACT

This invention relates to hand-held light weapon firing devices. To resolve the present problem of the excessive length of the work travel of the firing device trigger, with large frictional surface resistance between the blocking iron and the track, thus directly affecting the precision of firing. It is characterized in that it has a rotating blocking iron, which is fixed to the firing mount by the rotating blocking iron shaft; the rotating blocking iron shaft, the rotating blocking iron shaft hole and the hole in the frame for the rotating blocking iron shaft together forming a rotating assembly. This converts the translational friction of the original blocking iron on the track into rotational friction, the linear translational motion of the original blocking iron becoming the eccentric rotational motion of the rotating blocking iron, reducing the length of travel of the trigger from 6~7 mm to 2~2.5 mm, reducing frictional resistance and making it easy to operate during firing, thus creating the conditions for improvement in and guarantee of precision in firing.

1 Claim, 1 Drawing Sheet

FIRING MECHANISM WITH PIVOTING SEAR

TECHNICAL FIELD

This invention relates to hand-held light weapon firing devices.

BACKGROUND

In existing hand-held light weapon firing devices, such as the 7.62 mm automatic rifle; there are structural defects such as: a groove formed in the blocking iron or sear of the firing device has a groove, and a guide track which forms a sliding assembly with the aforesaid groove formed on the firing mount. During firing, the blocking iron or sear, performs translational motion on the guide-track of the firing mount. The results of this are, firstly, that the work travel of the trigger is excessively long; and, secondly, the surface friction between the guide-track and the groove sliding assembly is considerable, so that it is hard for the gunner to carry out control operations, and it directly affects the precision of the firing. The literature most closely corresponding to this invention is the design material for the SKS semiautomatic rifle linear motion blocking iron firing device, pages as discussed at 306–307 of the 'Firearms Handbook' published by the Defense Industry Publishing House.

The aim of this invention is to improve upon the structure of the firing device described above. The design of the linear-motion blocking iron or sear is changed to enable the iron or sear, thus overcoming the structural defects of the above described existing firing devices.

SUMMARY OF THE INVENTION

This invention is characterized by a rotating blocking iron or sear on which there is a rotating blocking iron shaft hole A firing mount is provided, having a stop and a mount rotating blocking iron shaft hole for fixing the rotating blocking iron shaft. These holes are drilled in corresponding positions so that the rotating blocking iron shaft fixes the rotating blocking iron or sear onto the firing mount. The rotating blocking iron shaft, the rotating blocking iron shaft hole and the mount rotating blocking iron shaft hole together form a rotating assembly.

The following constitutes a further explanation of the invention via the accompanying diagrams and examples of implementation:

Figure 1:
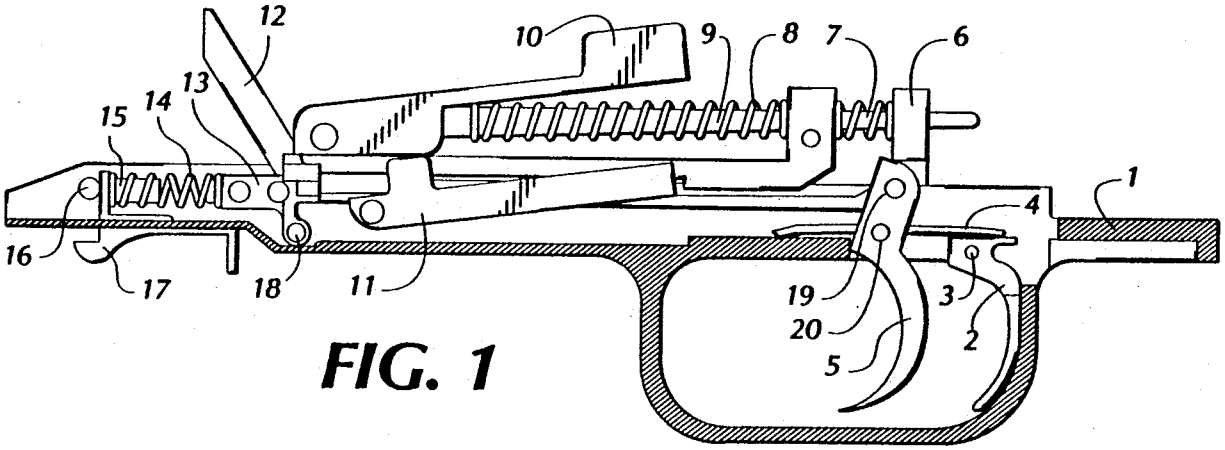
FIG. 1 is a side elevational view of the rotating blocking iron firing device taken in partial cross sectional.
Figure 3:
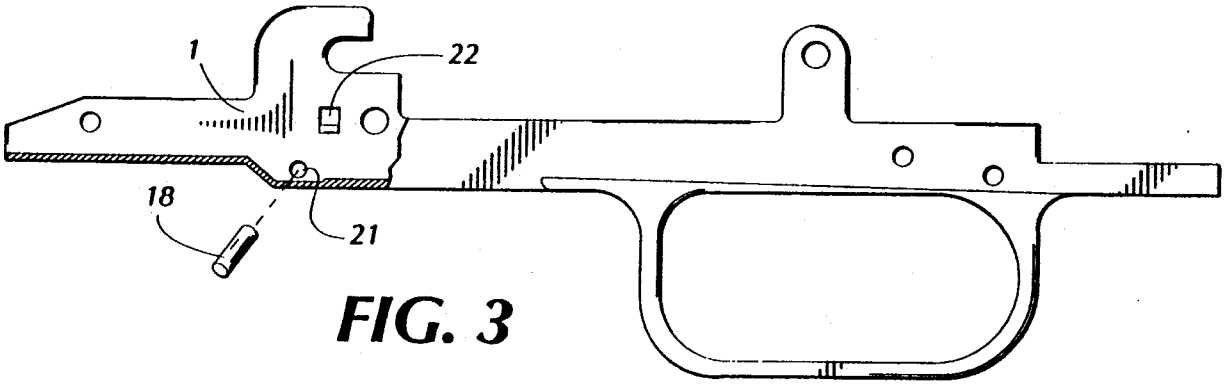
FIG. 3 is a diagram of the assembly of the rotating blocking iron.
Figure 2:
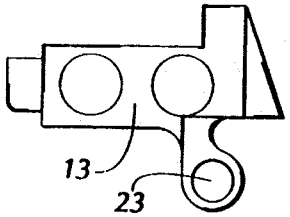
FIG. 2 is a side elevational view of the rotating blocking iron.

Key to the diagrams: 1. firing mount 2. safety catch 3. safety pin 4. safety spring 5. trigger 6. percussion link rod 7. trigger spring 8. percussion hammer spring 9. percussion hammer spring guide 10. percussion hammer 11. single shot lever 12. automatic firing shaft 13. rotating blocking iron or sear 14. blocking iron spring 15. blocking iron spring guide 16. mount shaft 17. cartridge store cover 18. rotating blocking iron shaft 19. automatic firing shaft 20. trigger pin 21. mount rotating blocking iron shaft hole 22. stop 23. rotating blocking iron shaft hole

DETAILED DESCRIPTION OF THE PREFERRED EMBODIMENT

As the accompanying diagrams show, the rotating blocking iron 13 or sear has a rotating blocking iron shaft hole 23 thereon, and the firing mount 1 has a stop 22 therealong, and has a mount rotating blocking iron shaft hole 21 formed along its length. The rotating blocking iron 13 is fixed by means of the rotating blocking iron shaft 18 onto the firing mount 1, so that the rotating blocking iron 13 can rotate on the firing mount 1, with the stop 22 on the firing mount fixing the position of the blocking iron 13 by preventing it from rotating backwards. As a result, it is possible to convert the translational friction of the prior art blocking iron or sear on the guide-groove guide track into rotational friction, and the translational motion of the prior art blocking iron or sear into eccentric rotational motion. This reduces the work travel of the trigger from 6~7 mm to 2~2.5 mm, and the multi-surface translational friction between the prior art blocking iron or sear, guide groove and the mutual contact with the firing mount guide track is eliminated and the relative motion between the sear and the firing mount involves pure rotational frictional resistance thereby reducing the attraction of the trigger. This makes it easier for the gunner to take aim and fire, and provides conditions for improved firing precision.

I claim:

1. A rotating blocking iron firing device for firearms comprising:

a firing mount;

a trigger pivotally mounted on said firing mount by means of a trigger pin;

a trigger bar pivotally mounted to said trigger and having a distal end;

a percussion hammer having an impact end and an opposite end, said percussion hammer being pivotally mounted intermediate its ends to said firing mount and having a lower front bearing surface on said opposite end;

a percussion hammer spring and spring guide adapted to drive said impact end of said percussion hammer when said trigger is pulled;

a blocking iron having first and second ends and adapted to engage and bear against said lower front bearing surface to hold said percussion hammer in a non-firing position, and having a blocking iron spring and spring guide;

said blocking iron being rotatably mounted on said firing mount by means of a blocking iron shaft extending through holes in said firing mount and a blocking iron shaft hole in said blocking iron at said first end thereof and said blocking iron spring bearing against said second end of said blocking iron;

said distal end of said trigger bar being adapted to bear against said blocking iron to rotate it in a first direction out of engagement with said bearing surface when said trigger is pulled, and;

stop means positioned along and integral with said firing mount to limit rotation of said blocking iron in a direction opposite to said first direction, in order to get the position of said blocking iron.

* * * * *